US009358444B2

(12) United States Patent
Ngo et al.

(10) Patent No.: US 9,358,444 B2
(45) Date of Patent: Jun. 7, 2016

(54) DISPLAY SYSTEM INCLUDING DC LOCALLY SYNCHRONIZED POWER LINE COMMUNICATION

(71) Applicant: OES, Inc., London (CN)

(72) Inventors: Kiet Ngo, Ontario (CA); Gordon John Hann Ngo, Ontario (CA)

(73) Assignee: OES, Inc., London, Ontario (CA)

( * ) Notice: Subject to any disclaimer, the term of this patent is extended or adjusted under 35 U.S.C. 154(b) by 324 days.

(21) Appl. No.: 13/645,590

(22) Filed: Oct. 5, 2012

(65) Prior Publication Data

US 2014/0098004 A1 Apr. 10, 2014

(51) Int. Cl.
*G09G 5/00* (2006.01)
*A63B 71/06* (2006.01)

(52) U.S. Cl.
CPC ..... *A63B 71/0669* (2013.01)

(58) Field of Classification Search
CPC ..... G09G 5/00
USPC ..... 345/1.1, 1.3
See application file for complete search history.

(56) References Cited

U.S. PATENT DOCUMENTS 3,727,213 A * 4/1973 Kurtenbach ..... 340/323 R
4,012,734 A 3/1977 Jagoda et al.
4,263,736 A * 4/1981 Beierwaltes et al. ..... 40/452
4,556,866 A 12/1985 Gorecki
4,751,506 A * 6/1988 Brown ..... G09F 9/33 273/DIG. 26
5,898,587 A * 4/1999 Bell ..... A63B 71/06 340/323 R
5,969,704 A 10/1999 Green et al.
7,961,090 B2 6/2011 Hu
8,344,410 B2 * 1/2013 Wendler et al. ..... 257/99
2008/0220843 A1 * 9/2008 Kido ..... G07F 17/32 463/17
2009/0074041 A1 3/2009 Cappelletti et al.
2009/0243962 A1 * 10/2009 Hioki et al. ..... 345/1.3
2012/0093198 A1 4/2012 Dabak et al.

* cited by examiner

*Primary Examiner* — Kent Chang
*Assistant Examiner* — Scott Au
(74) *Attorney, Agent, or Firm* — Carlson, Gaskey & Olds, P.C.

(57) ABSTRACT

According to an example embodiment, a display system includes, among other things, a plurality of displays. A corresponding plurality of processors are associated with the displays. Each processor is configured to control a displayed image on one of the associated displays. A controller is configured to provide a control signal to each of the processors. The control signal indicates a desired image to be displayed on the displays. Each of the processors is configured to receive the control signal and determine whether the control signal satisfies at least one criterion. Each processor is configured to determine a portion of the desired image to be displayed on the associated display based on the control signal. Each controller is also configured to control the associated display to display the portion of the desired image at a time corresponding a timing indicator.

13 Claims, 2 Drawing Sheets

DISPLAY SYSTEM INCLUDING DC LOCALLY SYNCHRONIZED POWER LINE COMMUNICATION

BACKGROUND OF THE INVENTION

Venues that host sporting events typically include a scoreboard that displays information such as the current score and time remaining in the event. Current trends in various sports include monitoring the remaining time to an accuracy on the order of a tenth of a second. A scoreboard displaying a tenth of a second must provide an extremely rapid response as time is expiring. Various arrangements have been proposed to provide scoreboard and timing systems to satisfy the needs of arena owners and sports enthusiasts.

A significant drawback associated with many scoreboard arrangements is that current design approaches are complex and cumbersome to produce. Extensive wiring is typically required inside the scoreboard enclosure. Individual conductors are required for powering each display panel on the scoreboard. Additional conductors are required for communicating between a master controller and each display panel. Direct control of each display panel by a master controller typically is required to provide the type of performance associated with tracking time in an accurate manner. The need for accuracy, however, typically requires significant material and labor costs. Additionally, the installation and service procedures associated with many scoreboard arrangements is tedious and complicated because of the many conductors utilized for direct connections between a master controller and the display panels.

SUMMARY OF THE INVENTION

According to an example embodiment, a display system includes, among other things, a plurality of displays. A corresponding plurality of processors are associated with the displays. Each processor is configured to control a displayed image on one of the associated displays. A controller is configured to provide a control signal to each of the processors. The control signal indicates a desired image to be displayed on the displays. Each of the processors is configured to receive the control signal and determine whether the control signal satisfies at least one criterion. Each processor is configured to determine a portion of the desired image to be displayed on the associated display based on the control signal. Each controller is also configured to control the associated display to display the portion of the desired image at a time corresponding to a timing indicator.

In an example embodiment, the control signal is provided over a power line that is also used for supplying power to the processors and the displays. The control signal is modulated over the power line. In an example embodiment, the power comprises DC power and a control signal comprises a modulated DC signal.

In an example embodiment, the controller provides the control signal with a beginning and an end. The controller leaves a time between the end of one control signal and the beginning of a subsequent control signal. In one example the beginning of the subsequent control signal is the timing indicator that each processor uses for initiating the display of the portion of the desired image from the previous control signal.

According to an example embodiment, a method of operating a time display system includes providing a control signal from a controller to each of a plurality of processors. The control signal indicates a desired image to be displayed on displays. Each processor is associated with a different one of the displays in one example. Each of the processors determines a portion of the desired image to be displayed on the display associated with that processor. Each processor controls the associated display to display the portion of the desired image at a time corresponding to a timing indicator from the controller.

Systems and methods designed according to an embodiment of this invention, provide a unique control strategy that provides an ability to achieve a desired accuracy for displaying information that must change in a rapid fashion such as the remaining time in a sporting event displayed on a scoreboard. A system or method designed according to an embodiment of this invention provides such accuracy while realizing the benefit of reducing or minimizing the amount of wiring required within a scoreboard system.

Various features and advantages of at least one disclosed example embodiment will become apparent to those skilled in the art from the following detailed description. The drawings that accompany the detailed description can be briefly described as follows.

DETAILED DESCRIPTION

Figure 1:
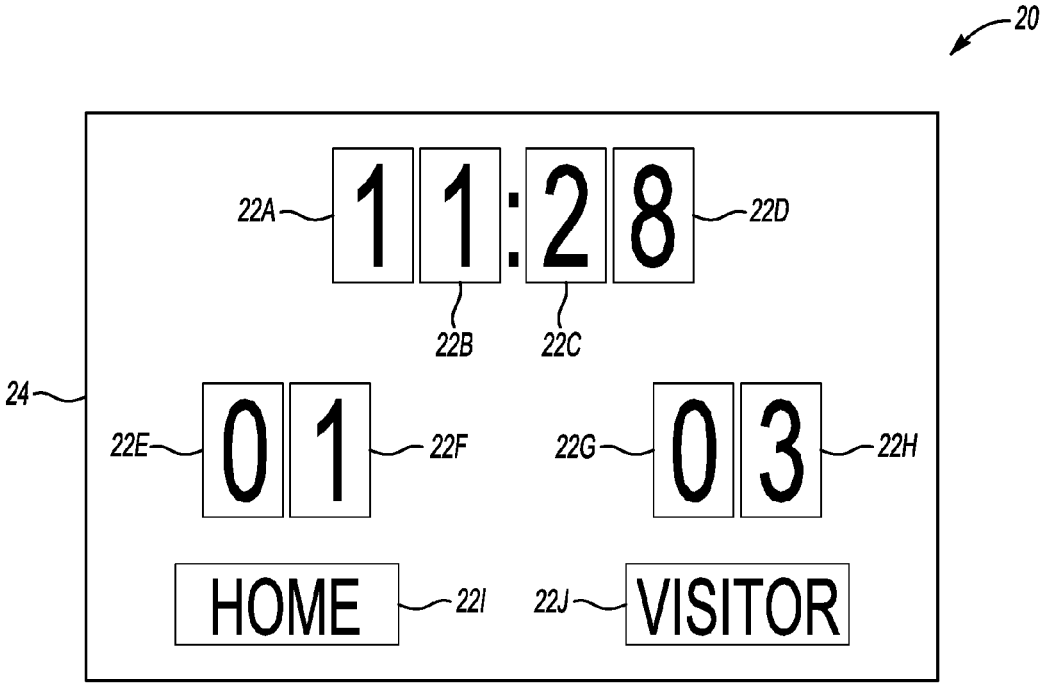
FIG. 1 schematically illustrates a display system designed according to an embodiment of this invention.

FIG. 1 schematically illustrates a display device 20. In this example, the display device 20 comprises a scoreboard useful for sporting events, for example. The display system 20 includes a plurality of displays 22, each of which may be realized using a single display panel.

In the illustrated example, displays 22A-22D are used for displaying a remaining amount of time in a sporting event. Displays 22E-22H are used for displaying the score achieved by a participant in the sporting event. Displays 221 and 22J are used to indicate those who are participating in the sporting event.

Each of the displays 22 is supported by a housing 24. All of the electronics and wiring required for operating the displays 22 is housed within the housing 24 in this example.

Figure 2:
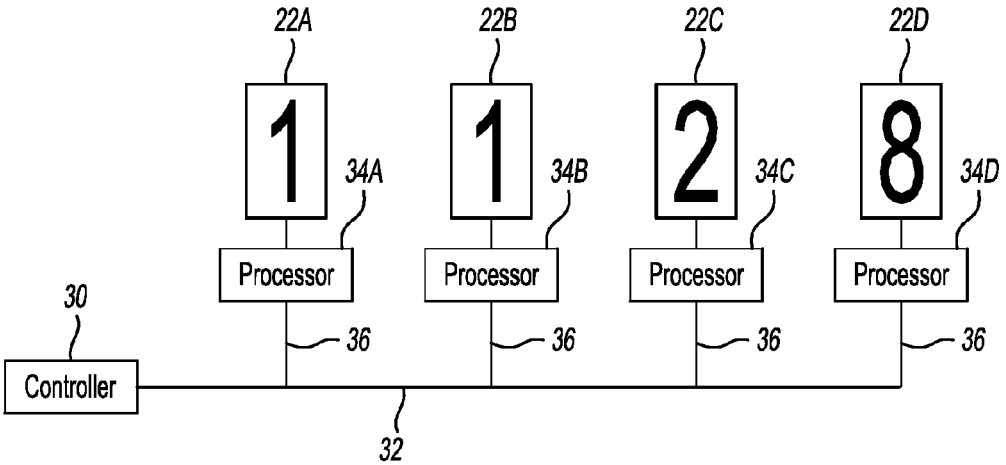
FIG. 2 schematically illustrates an example arrangement of selected portions of the display system in the example of FIG. 1.

FIG. 2 schematically illustrates an arrangement of selected portions of the display system 20 from FIG. 1. In this example, a main controller 30 is responsible for the overall operation of the display system 20. A power line 32, which may comprise a single wire or conductor in some embodiments, is provided within the housing 24 (FIG. 1). The controller 30 communicates with a plurality of processors 34 over the power line 32. In this example, the power line 32 is used for providing DC power to each of the processors 34 and each of the displays 22. The power line 32 also serves as a carrier for a modulated control signal from the controller 30. The control signal provides an indication of a desired image to be displayed on the displays 22.

In FIG. 2, each display 22 has an associated, dedicated processor 34. A connector or coupling member 36 provides an electrically conductive connection between the processors 34 and the power line 32. The illustrated arrangement significantly reduces the amount of wiring required within a display system such as a scoreboard. When the number of displays or display panels increases, the number of wires typically increases and the complexity of the arrangement within a housing also increases. With the illustrated example, using a single power line 32 to provide power and control signal information for operating each of the displays significantly reduces the amount of wiring required, which enhances the economies associated with assembling and servicing a display system such as a scoreboard.

One challenge associated with providing accurate time information on a scoreboard at a sporting event is that each display must update the content of the time image displayed on the displays collectively in a manner that is synchronized with the other displays. For example, if the remaining time changes from a first value to a second value that requires a change in the portion of the displayed image on more than one of the displays it would be possible for a temporary display of inaccurate information if that change is not properly synchronized. With the use of high speed cameras it is possible for an inaccurate time display to be recorded in the event that an improperly timed or unsynchronized change of the display contents were to occur.

With previous arrangements, a main controller would communicate with each of the displays directly and individually control each display. That type of arrangement provides synchronization, however, requires the complex and cumbersome wiring arrangements described above. The illustrated example uses a streamlined wiring approach that does not allow for a main controller to individually control each of the displays. Instead, the illustrated example provides for synchronized control over changes to the contents of the displayed image on each of the displays based on a control strategy that provides for proper synchronization while still realizing the benefits associated with reducing the amount of wiring required within the display system 20.

Figure 3:
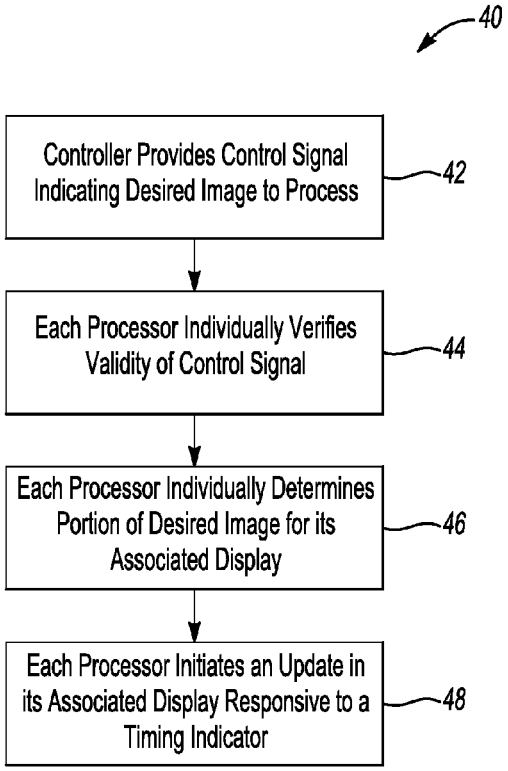
FIG. 3 is a flow chart diagram summarizing an example approach.

FIG. 3 includes a flow chart diagram 40 that summarizes an example approach. At 42 the controller 30 provides a control signal that indicates a desired image. The control signal is provided to each of the processors 34. The control signal is provided, through modulation over the DC power for example, on the power line 32.

At 44, each processor individually verifies the validity of the control signal. One way in which the validity of the control signal is verified is by each processor determining that the content of the desired image is different than the content of a currently displayed image. For example, each processor may be programmed to recognize a change in displayed time compared to a currently displayed time. If a control signal does not indicate an appropriate change in time, the control signal is not considered valid and the processors do not take any action responsive to it.

Assuming that the control signal is valid, at 46 each processor individually determines the portion of the desired image that should be displayed on its associated display. Considering FIG. 2, for example, the processor 34A receives the control signal from the controller 30. The control signal contains information regarding the entire displayed image because the control signal is provided to all processors that are receiving information over the power line 32. The processor 34A determines that the number one should be displayed on the display 22A. Similarly, the processor 34B determines that the display 22B should display the number one in response to the control signal. The processor 34D determines that the image on the display 22D should be the number seven which will replace the number eight (which is part of the current, collectively displayed image shown in FIG. 2).

The illustrated arrangement includes a recognition that there may be differences in the processing time associated with each of the processors 34. If one of the processors were to process the control signal faster than another and immediately update its associated display, that creates the possibility of having an at least temporarily inaccurate image displayed collectively on the display panels 22. The controller 30 provides a timing indicator to the processors 34 that the processors 34 use for purposes of initiating the display of the desired image on the displays 22. In FIG. 3, the processors initiate and update the associated display responsive to the timing indicator as shown at 48.

Figure 4:
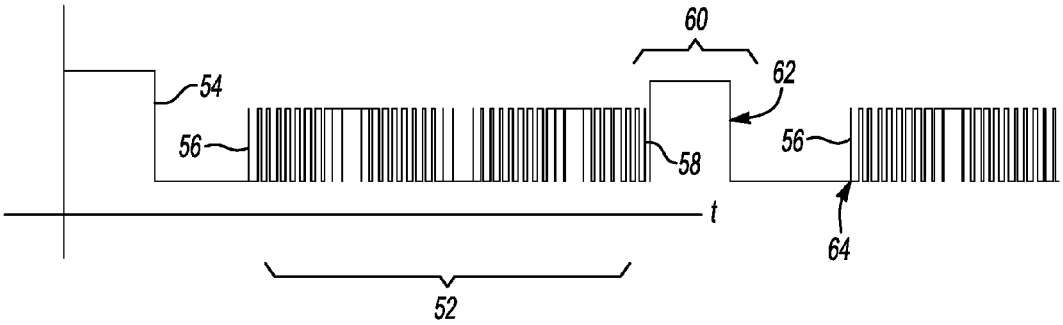
FIG. 4 is a timing diagram schematically illustrating an example control signal and an example timing indicator.

FIG. 4 is a graphical representation 50 of an example control signal 52 that is modulated over DC power schematically represented at 54. In this example, the controller 30 provides the control signal 52 with a beginning 56 and an end 58. The controller 30 ensures that at least a preselected amount of time shown at 60 exists between the end 58 of one control signal 52 and a beginning 56 of a subsequent control signal provided to the processors 34. In this example, the timing indicator used by the processors 34 for initiating the change to the image content on their associated displays is provided by the controller 30 when or after the preselected time 60 has expired.

One example timing indicator is shown at 62 in FIG. 4. The timing indicator 62 comprises a change in the DC power state on the power line 32. Each processor 34 in this example is programmed to recognize the end 58 of the control signal 52, to determine that at least the preselected amount of time 60 has passed and then to recognize a change in the DC power state on the power line 32 as schematically shown at 62 as an indicator that the update to the display should be initiated.

Another example timing indicator is shown at 64 in FIG. 4. This example timing indicator 64 comprises the beginning 56 of a subsequent control signal received by the processors 34 after having processed the control signal 52. In one such example, the beginning of each control signal includes a marker that is readily recognized by the processors 34, such as a change in DC voltage on the power line 32, that provides a timing indicator to which the processors 34 respond by initiating an update to the image contents on their associated display.

In one example the timing indicator comprises a hardware interrupt provided by the controller 30 to each of the processors 34 at the start of transmitting a new data packet containing a control signal. The hardware interrupt may comprise a change in voltage on the power line 32 as mentioned above.

Providing a separate timing indicator allows for each processor to properly process the control signal and then to initiate a change in the display image in a manner that is synchronized with any change required on any other of the displays. The timing indicator in the illustrated example provides for synchronized, simultaneous updates to any displays requiring a change in the portion of the displayed image shown on that display.

In the example arrangement, each of the processors 34 is programmed to update the image displayed on its associated display only if at least one criterion is satisfied and only upon the occurrence of a timing indicator. The example control strategy allows for using DC power, a single power line for providing power and control information to each of the displays (and their associated processors) while protecting against an unsynchronized change that would result in an at least temporarily inaccurate collectively displayed image. Additionally, reducing the amount of wiring required for operating the example display system 20 greatly enhances the economies associated with manufacturing and maintaining a display system such as a scoreboard useful for sporting events.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A display system, comprising:

a plurality of displays, each configured to display a different digit of a time of a sporting event;

a corresponding plurality of processors, each of the processors being associated with one of the displays and configured to control a displayed digit on the associated display; and a controller that is configured to provide a shared control signal to each of the processors, the control signal indicating a desired time to be collectively displayed by the displays, and the shared control signal having a beginning and an end in each update period;

each of the processors being configured to:

receive the shared control signal;

determine, from a first portion of the shared control signal, a desired digit that should be displayed on the associated display;

if the desired digit differs from a digit currently displayed on the associated display, update the associated display to display the desired digit at a time corresponding to a timing indicator in a second portion of the shared control signal; and if the desired digit is the same as the digit currently displayed, continue to display the digit currently displayed;

wherein the timing indicator is used by each of the plurality of processors, such that if multiple ones of the displays are to be updated during a current update period, such updates occur simultaneously; and wherein each processor only causes its associated display to display the desired digit indicated in a given update period if the second portion of the shared control signal in the given update period has a duration that is at least as long as a preselected amount of time.

2. The system of claim 1, comprising a power line coupled with the controller; and a plurality of connectors each coupling a corresponding one of the processors to the power line, wherein the shared control signal is communicated from the controller to the plurality of processors over the power line and the plurality of connectors.

3. The system of claim 2, wherein the power line provides power to the processors and the associated displays; and the shared control signal is modulated and communicated on the power line.

4. The system of claim 3, wherein the power comprises DC power; and the first portion of the shared control signal comprises a modulated DC signal.

5. The system of claim 1, wherein the timing indicator comprises at least one of a change in state of DC power supplied to the processors or the beginning of a subsequent, consecutive update period in the shared control signal.

6. The system of claim 1, comprising a housing; and wherein the displays are supported on the housing, the processors are supported at least partially within the housing and the controller is supported at least partially within the housing.

7. The system of claim 1, wherein within a given update period, the second portion of the control signal is subsequent to the first portion of the control signal.

8. A method of operating a time display system that includes a plurality of displays each associated with a respective processor, and a controller that is configured to communicate with the processors, the method comprising:

providing a shared control signal from the controller to each of the processors with a beginning and an end in each update period, the shared control signal comprising, in each of a plurality of consecutive update periods:

a first portion indicating, for each respective processor, a desired digit to be displayed on the respective associated display; and a second portion comprising a timing indicator that indicates when the desired digits should be simultaneously displayed;

determining, at each of the processors, whether the desired digit differs from a digit currently displayed on the respective associated display;

controlling each of the displays, using the associated processors, respectively, to:

if the desired digit differs from a digit currently displayed on the associated display, display the respective desired digit at a time corresponding to the timing indicator; and if the desired digit is the same as the digit currently displayed, continue to display the digit currently displayed;

using the timing indicator by each of the plurality of processors, to ensure that updates to multiple ones of the displays during a current update period occur simultaneously; and causing the displays to display the respective desired digits for a given update period only if a duration of the second portion of the shared control signal in the given update has a duration that is at least as long as a preselected amount of time.

9. The method of claim 8, wherein there is a power line coupled with the controller; and a plurality of connectors each coupling a corresponding one of the processors to the power line;

the method comprising communicating the shared control signal from the controller to the plurality of processors over the power line and plurality of connectors.

10. The method of claim 9, comprising supplying power on the power line to the processors and the associated displays;

modulating a control signal; and communicating the modulated control signal over the power supplied on the power line as the shared control signal.

11. The method of claim 10, wherein the power line comprises a DC power line;

the power comprises DC power; and the shared control signal comprises a modulated DC signal.

12. The method of claim 8, wherein the timing indicator comprises at least one of a change in state of DC power supplied to the processors or the beginning of a subsequent, consecutive update period in the shared control signal.

13. The method of claim 8, wherein within a given update period, the second portion of the control signal is subsequent to the first portion of the control signal.

* * * * *